US006473907B1

(12) United States Patent
Harwood

(10) Patent No.: US 6,473,907 B1
(45) Date of Patent: Nov. 5, 2002

(54) DUAL-VISOR CAP

(76) Inventor: Michael S. Harwood, 900 S. 5th St., Cottonwood, AZ (US) 86326-4325

( * ) Notice: Subject to any disclaimer, the term of this patent is extended or adjusted under 35 U.S.C. 154(b) by 0 days.

(21) Appl. No.: 10/043,005

(22) Filed: Jan. 8, 2002

Related U.S. Application Data

(60) Provisional application No. 60/302,263, filed on Jun. 29, 2001.

(51) Int. Cl.[7] ..... A42B 1/24

(52) U.S. Cl. ..... 2/209.13; 2/12; 2/195.1

(58) Field of Search ..... 2/10, 12, 171.1, 2/171.7, 195.1, 195.2, 181, 171.4, 209.13, 209.12, 175.1

(56) References Cited

U.S. PATENT DOCUMENTS

| | | | | | |
|---|---|---|---|---|---|
| 1,232,992 | A | | 7/1917 | Stering | |
| 1,716,719 | A | * | 6/1929 | Christopher | 2/175.1 |
| 2,855,604 | A | | 10/1958 | Austin | |
| 4,916,754 | A | * | 4/1990 | Kang | 2/12 |
| 5,091,995 | A | * | 3/1992 | Oates | 2/12 |
| 5,437,062 | A | | 8/1995 | Douglas | |
| 5,471,684 | A | | 12/1995 | Casale | |
| 5,533,211 | A | | 7/1996 | Mehrens | |
| 5,553,325 | A | * | 9/1996 | Gutierrez | 2/181 |
| 5,692,244 | A | * | 12/1997 | Johnson et al. | 2/12 |
| 5,701,607 | A | | 12/1997 | Kaiser | |
| 5,715,534 | A | | 2/1998 | Mobley | |
| 5,870,772 | A | | 2/1999 | Sprouse | |
| 5,898,935 | A | | 5/1999 | Davis | |
| 6,009,555 | A | * | 1/2000 | Siprut | 2/12 |
| 6,079,052 | A | | 6/2000 | Veridiano | |
| 6,237,147 | B1 | | 5/2001 | Brockman | |

* cited by examiner

*Primary Examiner*—John J. Calvert
*Assistant Examiner*—Katherine Moran
(74) *Attorney, Agent, or Firm*—John D. Lister

(57) ABSTRACT

A dual-visor cap assembly includes a cap having a crown portion, a first visor, and a second visor. The first visor is secured to the lower peripheral edge of the crown portion at the front of the crown portion. The second visor is secured to and carried by an adjustable length strap that passes through strap loops on the crown portion so that the strap and second visor are rotatively and detachably mounted on the crown portion adjacent the lower peripheral edge of the crown portion. The second visor is normally located at the front of the crown portion, centered and resting on the first visor, but can be selectively moved from the centered position on the first visor to either side to shade a wearer's face from a selected side while the first visor continues to shade the wearer's face from the front.

18 Claims, 2 Drawing Sheets

DUAL-VISOR CAP

This patent application is a continuation-in-part of provisional patent application Ser. No. 60/302,263, filed Jun. 29, 2001.

BACKGROUND OF THE INVENTION

The subject invention relates to a cap assembly and preferably a baseball style cap assembly with a crown portion and two visors. The cap assembly can be worn with the second visor overlying the first visor so that the cap assembly appears to have only one visor or the second visor can be rotated to either side so that the cap assembly can be used to simultaneously shade a wearer's face from the front and either side. In addition, the second visor is carried on a strap that is detachably mounted on the crown portion of the cap assembly so that the second visor can be worn independently of the crown portion and first visor of the cap assembly.

There are numerous caps with a single detachable or rotatively mounted visor as exemplified by the following U.S. Pat. Nos. 1,232,992; 2,855,604; 5,437,062; 5,471,684; 5,533,211; and 5,870,722. However, these caps cannot simultaneously shade a wearer's face from the front and a selected side.

U.S. Pat. No. 5,701,607, discloses an overlay 10 for the bill or visor of a cap that may protect the bill or visor, provide a means to apply printed matter to the bill or visor, or provide a means to change the color of the bill or visor. However, the use of these overlays does not enable the cap to simultaneously shade a wearer's face from the front and a selected side nor can the overlay be worn independently as a visor.

U.S. Pat. No. 5,715,534, discloses a hat in FIGS. 10 and 11 with an upper crown 54, a lower crown 55, and two bills 52, 53. However, as shown, the upper and lower crowns 54 and 55 are permanently sewn together with the bills 52 and 53 spaced vertically apart and the crown 54 carrying the bill 52 can not be separated from the crown 55 carrying the bill 53 so that the crowns with their bills can be worn separately.

U.S. Pat. No. 5,898,935, discloses a cap with adjustable and interchangeable visor attachments such as the protective eyewear shown in FIG. 5. U.S. Pat. No. 6,079,052, discloses a cap with removable forwardly extending side flaps 20. U.S. Pat. No. 6,237,147, discloses lateral clip-on sun shields that can be attached to the visor of a baseball cap.

The caps disclosed in the above-discussed patents are of interest in that these patents show various approaches for shading a wearer's face with caps that include visors, flaps and shields. However, there has remained a need for a cap and in particular, a baseball style cap with two visors, that is capable of simultaneously shading the wear's face from both the front and a selected side wherein: a) for the convenience of the wearer, the visor for shading a selected side of the wearer's face can be inconspicuously stored out of the wearer's way when not in use so that the visor does not become a nuisance; b) for aesthetic reasons, when simultaneous shading of the wearers face from the front and a selected side is not desired, the cap looks like a standard baseball type cap having a single visor; and c) the visor for shading a selected side of the wearer's face can be simply and easily removed from the cap and worn as a visor independently of the remainder of the cap. The cap assembly of the subject invention fulfills all these needs and fulfills all of these needs through the use of an inexpensive construction.

SUMMARY OF THE INVENTION

The cap assembly of the subject invention, preferably a baseball type cap assembly, includes a cap assembly having a crown portion, a first visor, and a second visor. The first visor is secured to the front of the crown portion and extends forward from the lower peripheral edge of the crown portion of the cap assembly. The crown portion of the cap assembly can be sized to fit a particular head size or the crown portion of the cap can be adjustable to fit wearers having a range of head sizes. The second visor is secured to and carried by an adjustable strap that passes through strap loops on the crown portion of the cap assembly so that the strap and second visor are rotatively and detachably mounted on the crown portion of the cap assembly adjacent the lower peripheral edge of the crown. The second visor is normally located at the front of the crown portion, centered and resting on the first visor, but can be selectively moved from the centered position on the first visor to either side to shade a wearer's face from a selected side while the first visor continues to shade the wearer's face from the front. Preferably, the second visor is detachably secured to the first visor, when the second visor is centered and resting on the first visor, by a simple snap fastener such as a fabric attachment snap fastener or another conventional releasable fastener. In addition, the strap and second visor can be detached from the crown portion of the cap assembly and worn independently of the crown portion and the first visor of the cap assembly.

DESCRIPTION OF THE PREFERRED EMBODIMENT

Figure 5:
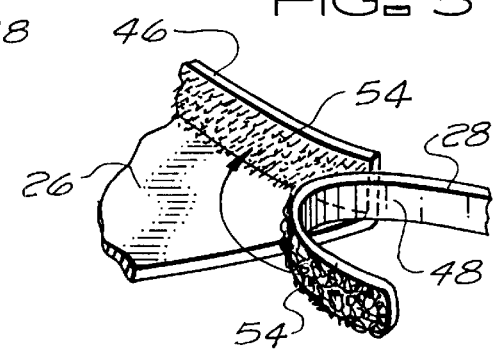
FIG. 5 is a partial perspective view of the second visor and strap with a hook and loop fastener on the strap rather than the snap fastener arrangement shown in FIGS. 1 to 3.

As shown in FIGS. 1 to 4, the dual-visor cap assembly 20 of the subject invention includes a crown portion 22, a first visor 24, a second visor 26 and an adjustable length strap 28 that carries the second visor 26. The crown portion 22 of the cap assembly 20 is typically formed by a plurality of gores 30, 32, 34, 36, 38 and 40 that are stitched or otherwise secured together to form the crown portion of the cap assembly. The gores 30 to 40 can be made of various fabrics commonly used in the industry and various logos, emblems, etc. can be stitched into, sewn on or otherwise incorporated into the crown portion 22 of the cap assembly 20. Where the cap assembly 20 is adjustable to fit wearers having a range of head sizes, one or more of the gores, e.g. gore 36 at the rear of the crown portion 22, can be made of a fabric that is elastic in the direction of the lower peripheral edge 42 of the crown portion of the cap assembly 20 so that the crown portion 22 can be stretched to fit a range of head sizes. Another way (not shown) of making the crown portion 22 of the cap assembly 20 adjustable to fit wearers having a range of head sizes is to have an open area at the rear of the crown portion 22 with adjustable-length straps fitted with snap or other conventional fasteners spanning the open area. FIG. 5 of U.S. Pat. No. 5,437,062, discloses such an adjustment arrangement and the disclosure of U.S. Pat. No. 5,437,062, issued Aug. 1, 1995 is hereby incorporated by reference in its entirety.

Preferably, the first visor 24 is shaped like a baseball style cap visor and is semistiff or semi-rigid so that the first visor will hold its shape. For example, the first visor 24 may be made with a paperboard or cardboard core, not shown, over which a cloth or fabric is stitched or adhesively bonded or a coating is applied so that the first visor 24 may be molded into and will retain a desired shape, e.g. the slightly curved shape of a typical baseball style cap visor. The first visor 24 is stitched to or otherwise secured to the front of the crown portion 22 of the cap assembly 20 and extends forward from the lower peripheral edge 42 of the crown portion 22 of the cap assembly 20.

The second visor 26 has the same shape as or substantially the same shape as and is the same size as or substantially the same size as the first visor 24. Preferably, like the first visor 24, the second visor 26 is shaped like a baseball style cap visor and is semi-stiff or semi-rigid so that the first visor will hold its shape. The second visor 26, like the first visor 24, may be made with a paperboard or cardboard core, not shown, over which a cloth or fabric is stitched or adhesively bonded or a coating is applied so that the second visor 26 may be molded into and will retain a desired shape, e.g. a shape conforming to the shape of the first visor 24 such as the slightly curved shape of a typical baseball style cap visor. The second visor 26 is stitched to or otherwise secured to the adjustable length strap 28 and extends forward from the lower edge 44 of the adjustable strap 28.

Figure 1:
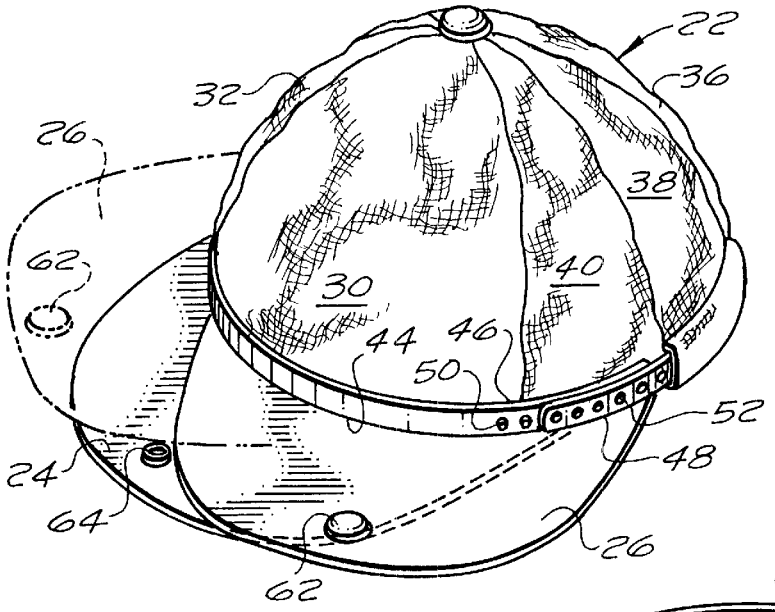
FIG. 1 is a perspective view of the dual-visor cap assembly of the subject invention with the second visor shifted to one side.
Figure 2:
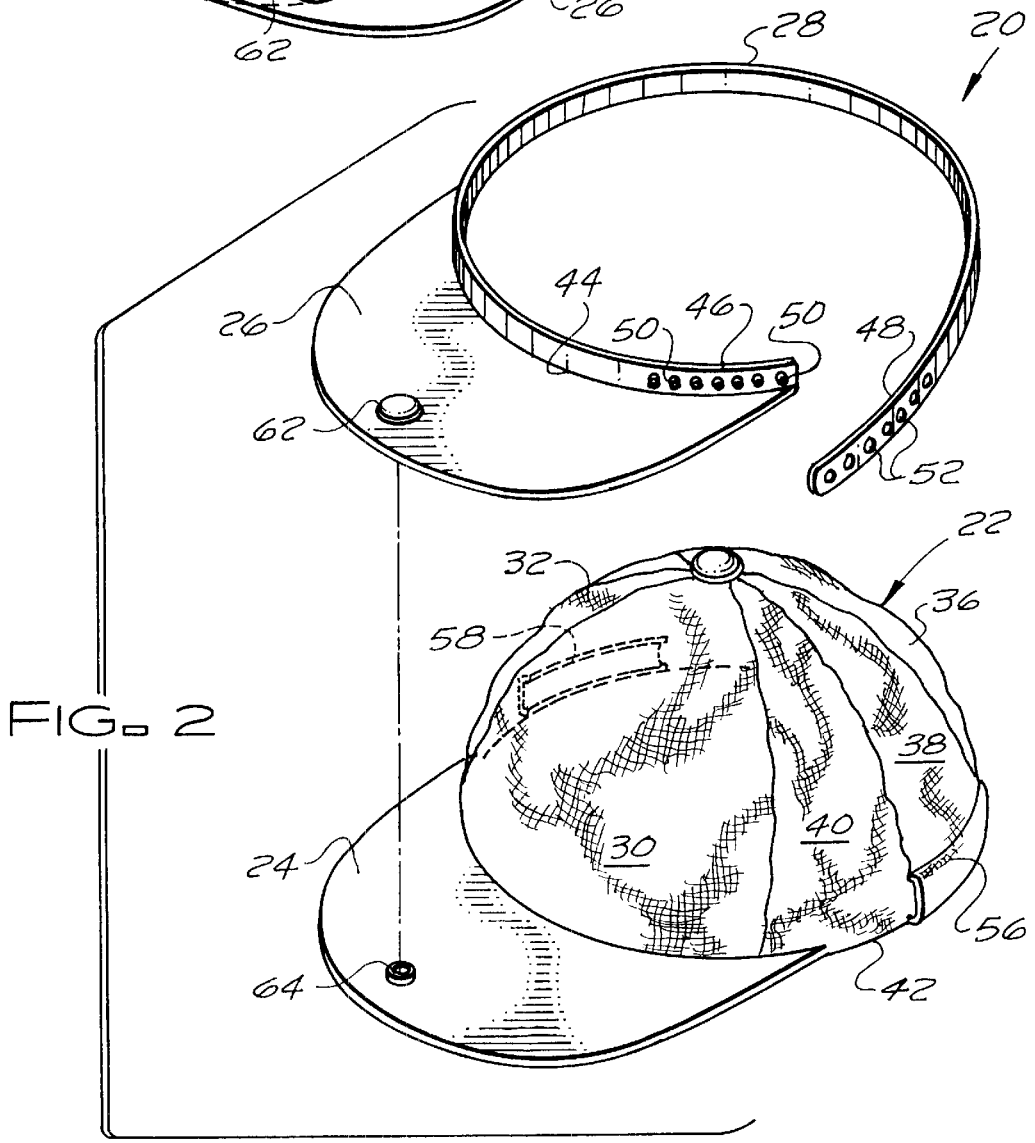
FIG. 2 is an exploded perspective view of the dual-visor cap assembly of the subject invention showing the second visor detached from the crown portion of the cap assembly that carries the first visor.
Figure 3:
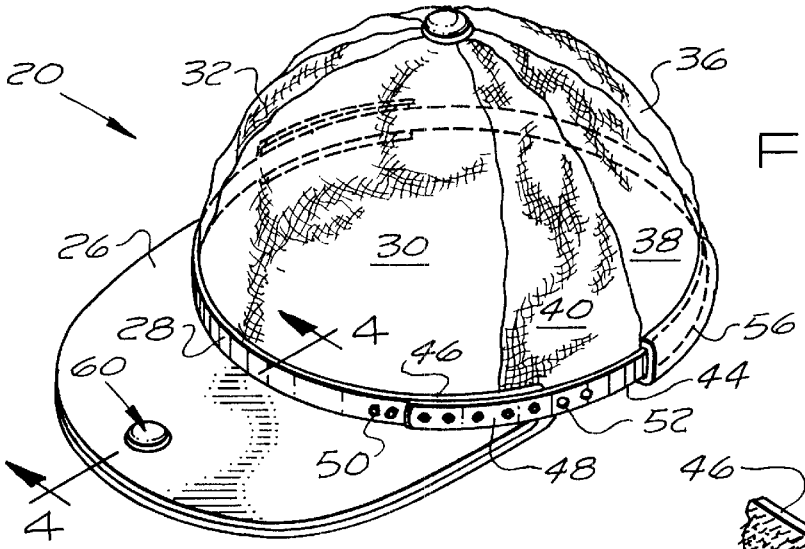
FIG. 3 is a perspective view of the dual-visor cap assembly of the subject invention with the second visor centered over, resting on and secured to the first visor.

The adjustable length strap 28 has first and second end portions 46 and 48 with a releasable fastener arrangement thereon so that the end portions of the adjustable length strap can be secured together to form a closed loop or detached from one another to open the loop. As shown in FIGS. 1 to 3, one preferred releasable fastener arrangement includes a series of projecting snap fastener elements 50 on the first end portion 46 of the adjustable length strap 28 and a series of holes 52 on the second end portion 48 of the adjustable length strap 28. The projecting snap fastener elements 50 on the first end portion 46 of the adjustable length strap 28 can be selectively snapped into the holes 50 in the second end portion 48 of the adjustable length strap 28 to secure the end portions 46 and 48 together to form a closed loop of a desired head size. The projecting snap fastener elements 50 on the first end portion 46 of the adjustable length strap 28 can also be unsnapped from the holes 52 in the second end portion 48 of the adjustable length strap 28 to open the loop so that the adjustable length strap 28 with the second visor 26 can be removed from the crown portion 22 of the cap assembly 20 and/or readjusted to fit another head size. FIG. 5 shows another preferred releasable fastener arrangement for the adjustable length strap 28. This arrangement 54 includes a hook and loop fastener on the first and second end portions 46 and 48 of the adjustable length strap 28, such as a VELCRO® fastener. The hook and loop fasteners on the first and second end portions 46 and 48 of the adjustable length strap 28 can be selectively hooked together to secure the end portions 46 and 48 of the adjustable length strap together to form a closed loop of a desired head size. The hook and loop fasteners on the first and second end portions 46 and 48 of the adjustable length strap 28 can also be unhooked to open the loop so that the adjustable length strap 28 with the second visor 26 can be removed from the crown portion 22 of the cap assembly 20 to be used independently of the crown portion 22 and the first visor 24 and/or readjusted to fit another head size. Thus, if circumstances warrant, one person can wear the crown portion 22 with the first visor 24 of the cap assembly 20 while another person can wear the adjustable length strap 28 with the second visor 26 of the cap assembly 20.

Preferably, the second visor 26 is secured to the adjustable length strap 28, at one end portion of the strap. While as shown in FIGS. 1 to 3, the visor 26 is secured to the adjustable length strap 28 at the first end portion 46, the visor may also be secured to the adjustable length strap 28 at the second end portion 48 or intermediate the end portions. By having the second visor 26 secured to the adjustable length strap 28 at one of the end portions of the adjustable length strap 28, the releasable fastener arrangement on the adjustable length strap 28 (e.g. the projecting snap fastener elements 50 and the holes 52 or the hook and loop fastener 54) is easily reached to release or secure the fastener.

The crown portion 22 of the cap assembly 20 is provided with two retaining loops 56 and 58 for receiving the adjustable length strap 28 carrying the second visor 26 to mount the second visor 26 on the crown portion 22 of the cap assembly 20. The retaining loops 56 and 58 are located on each side of the crown portion 22 of the cap assembly 20 at or adjacent the lower peripheral edge 42 of the crown so that the adjustable length strap 28 carrying the second visor 26 is located at or adjacent the lower peripheral edge of the crown portion 22 of the cap assembly 20 and the second visor 26 rests on the first visor 24 when the second visor 26 is centered over the first visor 24. Preferably, the retaining loops are about one to two inches in length and when the cap assembly is worn with the first visor facing forward, the retaining loops 56 and 58 are located above the ears of the wearer. The openings in the retaining loops 56 and 58 through which the adjustable length strap 28 passes to mount the second visor 26 on the crown portion 22 of the cap assembly 20 are sized to accommodate the releasable fastener on the adjustable length strap 28 so that the releasable fastener can be rotated into and out of the retaining loops 56 or 58 when the second visor is rotated relative to the first visor. The retaining loops 56 and 58 may be made of various fabrics and materials commonly used in the industry for making baseball style caps.

Figure 6:
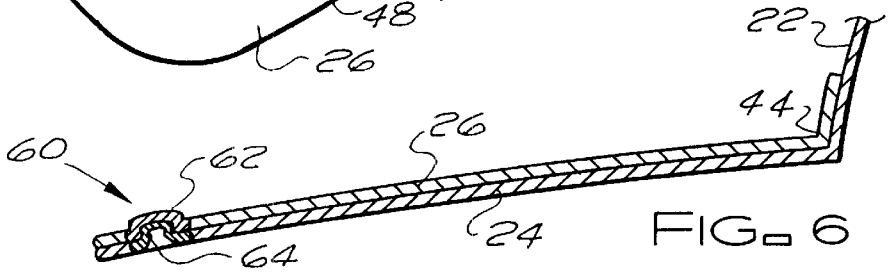
FIG. 6 is a partial vertical cross section through the dual-visor cap assembly of the subject invention taken substantially along lines 4—4 of FIG. 3.

Preferably, the first and second visors 24 and 26 are provided with a simple snap fastener 60 to hold the first and second visors securely together when the second visor 26 is centered over and resting on the first visor 24. As shown in FIG. 6, the snap fastener 60 includes a button 62 with a recess therein secured to the second visor 26 and a projecting snap fastener element 64 that is secured to the first visor. The projecting snap fastener element 64 can be snapped into the recess in the button 62 to secure the visors 24 and 26 together and can be unsnapped to separate the two visors 24 and 26. While a simple snap fastener such as the snap fastener 60 is preferred, a hook and loop fastener such as a VELCRO® fastener or other similar fastener may be used to hold the visors together.

Figure 4:
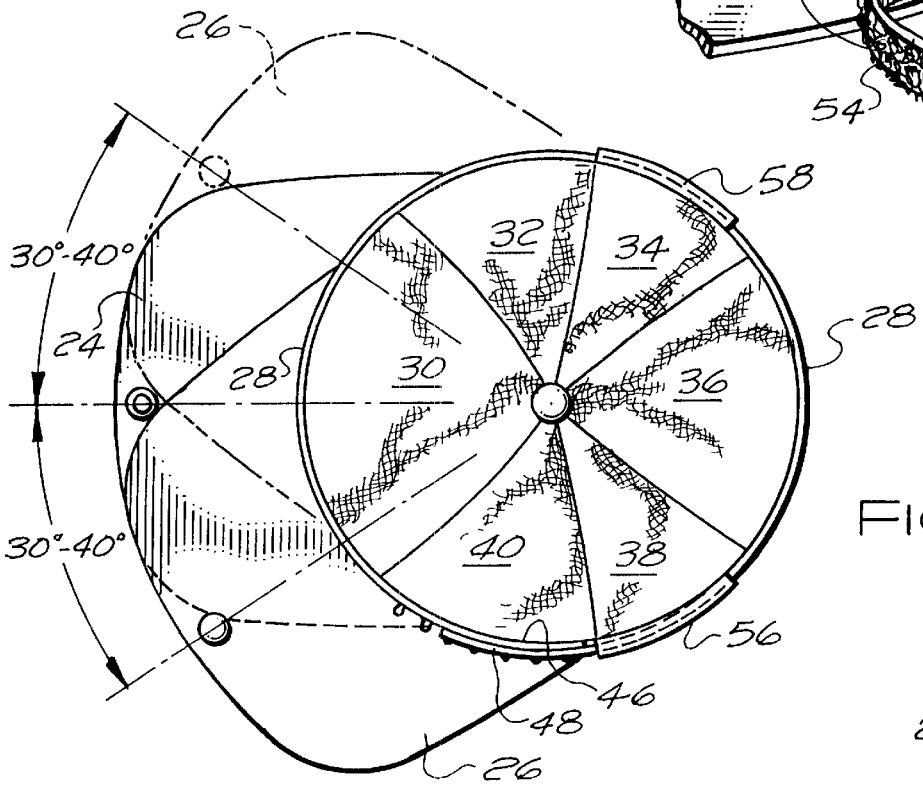
FIG. 4 is a plan view of the dual-visor cap assembly of the subject invention showing, in phantom line, the range of movement of the second visor relative to the first visor.

As shown in FIGS. 1 to 4, the adjustable length strap 28 carrying the second visor 26 normally passes through the strap retaining loops 56 and 58 on the crown portion 22 of the cap assembly 20 so that the adjustable length strap 28 and the second visor 26 are rotatively and detachably mounted on the crown portion 22 of the cap assembly at or adjacent the lower peripheral edge 42 of the crown portion. When not in use, the second visor 26 is normally located at the front of the crown portion 22, centered and resting on the first visor 24. In use, the second visor 26 can be selectively moved from the centered position on the first visor 24 to either side, as shown in FIG. 4, to shade a wearer's face from a selected side while the first visor 24 continues to shade the wearer's face from the front. The extent to which the second visor 26 can be rotated in either direction from its centered position over the first visor 24 is preferably at least 30°; more preferably at least 35°; and most preferably at least 40°. As best shown in FIG. 2, the adjustable length strap 28 and second visor 26 can be detached from the crown portion 22 of the cap assembly 20 and worn independently of the crown portion and the first visor of the cap assembly.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A dual-visor cap assembly, comprising:

a cap assembly including a crown portion, a first visor, and a second visor;

the crown portion having a front, a back, and first and second sides; the crown portion having a lower peripheral edge;

the first visor being secured to the front of the crown portion and extending forward from the lower peripheral edge of the crown portion;

a strap having first and second end portions; fastener means on the first and second end portions for releasably securing the first and second end portions together to form a closed loop; the strap having a lower peripheral edge; the second visor being secured to and carried by the strap and extending from the lower peripheral edge of the strap;

the crown portion having strap loops adjacent the lower peripheral edge of the crown portion on the first and second sides of the crown portion for receiving there through the strap carrying the second visor and for slidably retaining the strap carrying the second visor on the crown portion of the cap assembly adjacent the lower peripheral edge of the crown portion of the cap assembly; and the strap passing through the strap loops on the crown portion with the second visor normally located at the front of the crown portion and centered and resting on the first visor and the strap and the second visor being rotatively mounted on the crown portion so that the second visor can be selectively moved from the centered position on the first visor to the first side or the second side of the crown portion to shade a wearer's face from a selected side while the first visor continues to shade the wearer's face from in front of the wearer's face; and the first and second end portions of the strap being releasably secured together by the fastener means on the first and second end portions of the strap whereby, by unfastening the fastener means, the strap with the second visor can be separated from the crown portion of the cap assembly to be used independently of the crown portion and the first visor of the cap assembly.

2. The dual-visor cap assembly according to claim 1, wherein:

a releasable fastening means secures the second visor to the first visor when the second visor is centered and resting on the first visor.

3. The dual-visor cap assembly according to claim 2, wherein: the releasable fastening means is a snap fastener.

4. The dual-visor cap assembly according to claim 1, wherein:

the fastener means on the first and second end portions of the strap comprises a plurality of holes on the first end portion of the strap and at least one projecting snap fastener element on the second end portion of the strap that is received within any one of the holes on the first end portion of the strap to releasably secure the end portions of the strap together.

5. The dual-visor cap assembly according to claim 4, wherein:

a releasable fastening means secures the second visor to the first visor when the second visor is centered and resting on the first visor.

6. The dual-visor cap assembly according to claim 5, wherein:

the releasable fastening means is a snap fastener.

7. The dual-visor cap assembly according to claim 1, wherein:

the fastener means on the first and second end portions of the strap comprises a mating hook-and-loop fastener.

8. The dual-visor cap assembly according to claim 7, wherein:

a releasable fastening means secures the second visor to the first visor when the second visor is centered and resting on the first visor.

9. The dual-visor cap assembly according to claim 8, wherein:

the releasable fastening means is a snap fastener.

10. The dual-visor cap assembly according to claim 1, wherein:

the second visor can be rotated at least 30° to either side from the centered position on the first visor.

11. The dual-visor cap assembly according to claim 10, wherein:

a releasable fastening means secures the second visor to the first visor when the second visor is centered and resting on the first visor.

12. The dual-visor cap assembly according to claim 11, wherein:

the releasable fastening means is a snap fastener.

13. The dual-visor cap assembly according to claim 10, wherein:

the fastener means on the first and second end portions of the strap comprises a plurality of holes on the first end portion of the strap and at least one projecting snap fastener element on the second end portion of the strap that is received within any one of the holes on the first end portion of the strap to releasably secure the end portions of the strap together.

14. The dual-visor cap assembly according to claim 13, wherein:

a releasable fastening means secures the second visor to the first visor when the second visor is centered and resting on the first visor.

15. The dual-visor cap assembly according to claim 14, wherein:

the releasable fastening means is a snap fastener.

16. The dual-visor cap assembly according to claim 10, wherein:

the fastener means on the first and second end portions of the strap comprises a mating hook-and-loop fastener.

17. The dual-visor cap assembly according to claim 16, wherein:

a releasable fastening means secures the second visor to the first visor when the second visor is centered and resting on the first visor.

18. The dual-visor cap assembly according to claim 17, wherein:

the releasable fastening means is a snap fastener.

* * * * *